US005396145A

United States Patent [19]

Shiohara et al.

[11] Patent Number: 5,396,145

[45] Date of Patent: Mar. 7, 1995

[54] APERTURE GRILL HAVING ADDITIONAL SLITS PREVENTING DEFORMATION OF END SLITS AND CAPABLE OF INTERCEPTING LIGHT RAYS

[75] Inventors: Kenji Shiohara; Masaaki Asai; Shunji Suzuki, all of Aichi; Kiyoyasu Kuwayama, Gihu, all of Japan

[73] Assignee: Sony Corporation, Tokyo, Japan

[21] Appl. No.: 985,957

[22] Filed: Dec. 4, 1992

[30] Foreign Application Priority Data

Dec. 6, 1991 [JP] Japan ..... 3-323075

[51] Int. Cl.[6] ..... H01J 29/81

[52] U.S. Cl. ..... 313/402; 313/403; 313/407

[58] Field of Search ..... 313/402, 403, 407

[56] References Cited

U.S. PATENT DOCUMENTS 3,652,895 3/1972 Tsuneta et al. ..... 313/403
3,844,005 10/1974 Yamada et al. ..... 313/403
4,767,962 8/1988 Adler et al. ..... 313/402
5,086,250 2/1992 Van der Waal ..... 313/403

FOREIGN PATENT DOCUMENTS

0286187A2 10/1988 European Pat. Off. ..... H01J 29/07
3-62436 3/1991 Japan ..... 313/402
1248532 10/1971 United Kingdom ..... H01J 29/06

*Primary Examiner*—Donald J. Yusko
*Assistant Examiner*—Vip Patel
*Attorney, Agent, or Firm*—Hill, Steadman & Simpson

[57] ABSTRACT

The present invention provides an aperture grill capable of securing uniformity in the width of end slits among slits formed in an effective area of the picture of the flat grill plate of an aperture grill for a CAT or the like. In an aperture grill formed by joining the periphery of a flat aperture grill of a thin metal sheet provided with a plurality of slits to a frame, extra slits having a width smaller than that of the plurality of slits and capable of screening are formed in the flat aperture grill at positions outside the end slits among the plurality of slits at the opposite ends of the effective area of picture.

6 Claims, 5 Drawing Sheets

APERTURE GRILL HAVING ADDITIONAL SLITS PREVENTING DEFORMATION OF END SLITS AND CAPABLE OF INTERCEPTING LIGHT RAYS

BACKGROUND OF THE INVENTION

1. Field of the Invention

The present invention relates to an aperture grill and, more specifically to an aperture grill provided with a plurality of parallel, vertical slits arranged at regular intervals, to be used on a Trinitron picture tube.

2. Description of the Prior Art

In a Trinitron picture tube as shown in FIG. 5, three parallel electron beams 2 emitted by cathodes 1 are converged on the center axis of the Trinitron picture tube by a prefocusing electron lens 3 and a main focusing electron lens 4. The three electron beams 2 then diverge, the diverged three electron beams 2 converge on an aperture grill 6, namely, a shadow mask provided with a plurality of parallel, vertical slits in the effective area of the picture, by a convergence deflector 5. Then the three electron beams 2 pass through the slits of the aperture grill 6 and strike their intended color phosphor dots arranged to form stripes 7, respectively, among those formed on the inner surface of the panel of the Trinitron picture tube to make the intended color phosphor dots luminous.

The aperture grill 6 of the Trinitron picture tube has the function of a color screening electrode. Generally, the aperture grill 6 is constructed by attaching a flat grill plate, namely, a thin mild steel plate provided with a plurality of parallel, vertical slits (apertures) formed at regular intervals by etching in an effective area of picture, to a steel frame in a properly taut state.

In assembling the aperture grill 6, the flat grill plate is attached by seam welding to the frame elastically buckled by pressure, and then the pressure is removed from the frame to allow the frame to restore its normal shape by its own elasticity so that the flat grill plate welded to the frame is held in a taut state. Since tension distribution in the flat grill plate is not satisfactorily uniform when the frame is allowed to restore its normal shape by its own elasticity after welding the flat grill plate thereto, the respective widths of the slits of the flat grill plate are liable to differ more or less form each other.

The characteristics of the aperture grill, particularly, the curvature of the aperture grill corresponding to that of the panel, and the tension of the flat grill plate and the like necessary for the quality control of the aperture grill, are measured. The widths of the end slits at the opposite ends of the arrangement of the slits are inspected visually. This visually, which, however, is not necessarily a perfectly effective means of inspection.

Some aperture grills for a superfine picture tube are provided with dummy slits. The dummy slits are used for adjusting the widths of the end slits. In welding the flat grill plate to the frame, the dummy slits absorb irregularity in the distribution of tension in the flat grill plate so that the respective widths of the slits are equal to each other. However, it is not appropriate to use such an aperture grill provided with dummy slits as a mask in an exposure process for forming a fluorescent layer on the surface of a panel; portions of the panel outside the effective area of the picture corresponding to the dummy slits are exposed. Accordingly, when the aperture grill provided with the dummy slits is used as a mask, the dummy slits must be covered with masking means and the masking means needs to be removed after the exposure process, which requires an additional process. Thus, the use of the aperture grill provided with the dummy slits for the exposure process requires additional labor and additional equipment, and it is possible that defects are introduced into the aperture grill in covering the dummy slits. Accordingly, the use of the aperture grill provided with the dummy slits is not desirable.

SUMMARY OF THE INVENTION

Accordingly, it is an object of the present invention to provide an aperture grill provided with a plurality of parallel, vertical slits and capable of being constructed so that the end slits at the opposite ends of the effective area of picture are secured at a correct width.

The object of the present invention is achieved by an aperture grill comprising a frame, and a thin metal sheet provided with a plurality of parallel, vertical slits in an effective area of the picture and which has edges fixed to the frame. The thin metal sheet is provided with extra slits having a width smaller than that of the plurality of parallel, vertical slits and which are capable of intercepting light rays. They are formed in marginal portions of the sheet thereof outside the end slits at the opposite ends of the effective area of the picture.

The flat aperture plate of the aperture grill of the present invention is provided with an extra slit having a width smaller than that of the plurality of parallel, vertical slits, is capable of intercepting light rays an is formed outside the end slit (11*a*) of the plurality of slits. The extra slit serves as a dummy slit in assembling the aperture grill to maintain the end slits at the opposite ends of the effective area of the picture with a correct width.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1A:
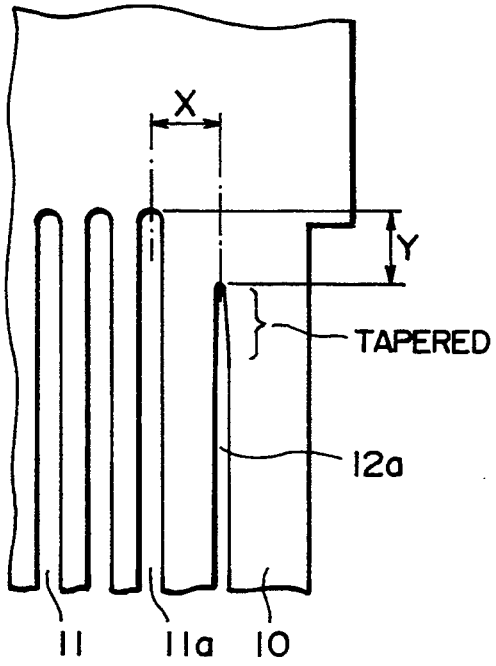
FIGS. 1(*a*) and 1(*b*) are a fragmentary plan view and a fragmentary enlarged sectional view, respectively, of a flat grill plate employed in an aperture grill in a first embodiment according to the present invention.
Figure 1B:
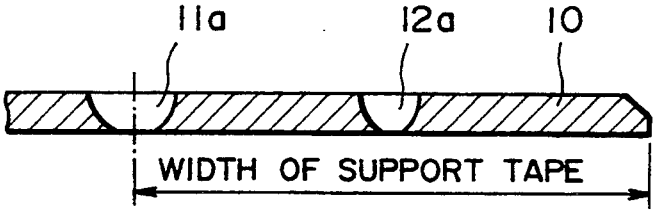

FIGS. 1(*a*) and 1(*b*) are a fragmentary plan view and a fragmentary enlarged sectional view, respectively, of a flat grill plate 10 employed in an aperture grill in a first embodiment according to the present invention, in which a frame surrounding the flat grill plate 10 is omitted.

As shown in FIG. 1(*a*), the flat grill plate 10 is a thin metal sheet provided with a plurality of slits 11. Extra slits 12*a* are formed by etching the thin metal sheet at positions outside of the end slits 11*a* among the slits 11 formed in an effective area of picture. An end portion of a length of about 10mm of the extra slit 12*a* is tapered. The width of the extra slit 12*a* is in the range of 40 to 70% of the width of the slits 11 formed in an effective area of picture. The slits 11 are arranged at a pitch a. The horizontal center distance X between the end slit 11 and the extra slit 12*a* is equal to the pitch a or 2*a*, and the vertical distance Y between the end of the end slit 11*a* and the end of the extra slit 12*a* is zero or 2*a*. As shown in FIG. 1(*b*), the extra slit 12*a* is formed in an area of a width corresponding to a width of a support tape of the frame.

The extra slits 12*a* thus formed in the aperture grill prevent a change in the width of the end slits 11*a* and are capable of screening.

Figure 2A:
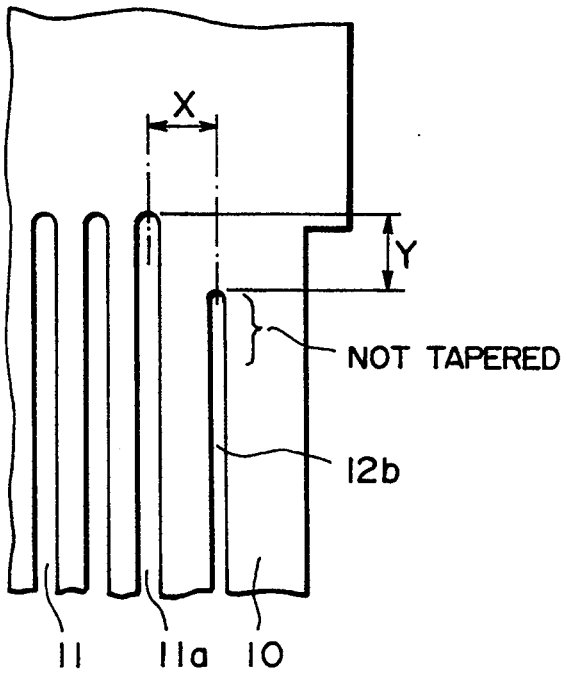
FIGS. 2(*a*) and 2(*b*) are a fragmentary plan view and a fragmentary enlarged sectional view, respectively, of a flat grill plate employed in an aperture grill in a second embodiment according to the present invention.
Figure 2B:
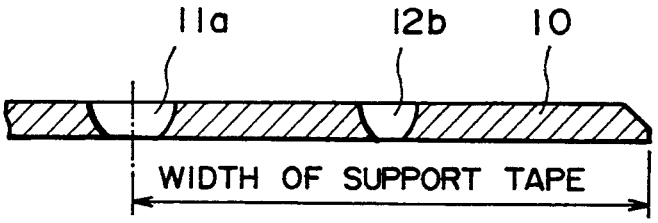

FIGS. 2(*a*) and 2(*b*) are a fragmentary plan view and a fragmentary enlarged sectional view of a flat grill plate 10 employed in an aperture grill in a second embodiment according to the present invention.

As shown in FIGS. 2(*a*) and 2(*b*), the flat grill plate 10, similarly to the flat grill plate of the first embodiment, is provided with extra slits 12*b*. Each extra slit 12*b* is a straight slit having a fixed width throughout the length. The position and width of the extra slits 12*b* are entirely the same as those of the extra slits 12*a* of the flat grill plate 10 of the first embodiment. The effect of the aperture grill in the second embodiment is similar to that of the aperture grill employing the flat grill plate shown in FIGS. 1(*a*) and 1(*b*).

Figure 3A:
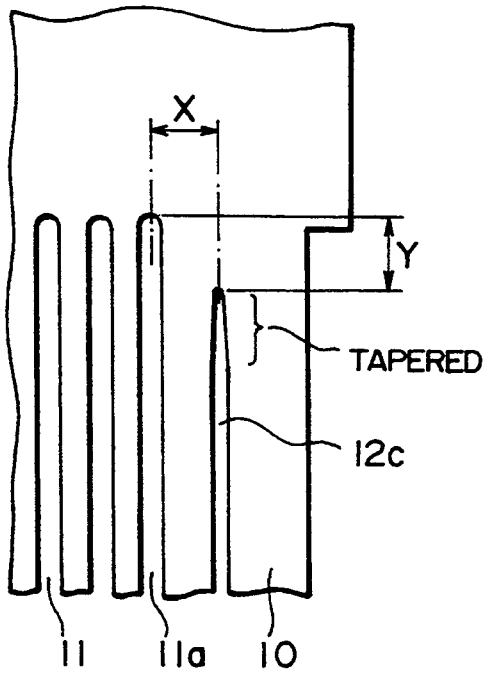
FIGS. 3(*a*) and 3(*b*) are a fragmentary plan view and a fragmentary enlarged sectional view, respectively, of a flat grill plate employed in an aperture grill in a third embodiment according to the present invention.
Figure 3B:
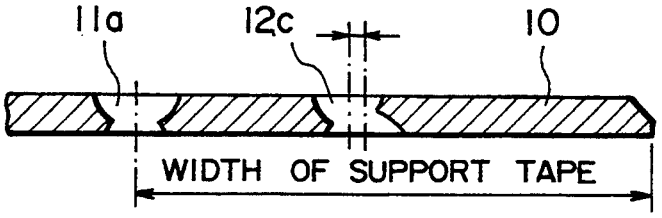

FIGS. 3(*a*) and 3(*b*) are a fragmentary plan view and a fragmentary sectional view, respectively, of an flat grill plate 10 employed in an aperture grill in a third embodiment according to the present invention.

As shown in FIGS. 3(*a*) and 3(*b*), the flat grill plate 10 is provided with an extra slits 12*c* each having a tapered end. As shown in FIG. 3(*b*), the center axis of the extra slit 12*c* on the front surface of the flat grill plate 10 and that of the same on the back surface of the flat grill plate 10 are dislocated relative to each other by a pattern shifting distance P to enable the extra slit 12*c* to intercept light falling on the flat grill plate 10. The width and position of the extra slits 12*c* are the same as those of the extra slits 12*a* of the flat grill plate 10 of the first embodiment. The effect of the aperture grill in the third embodiment is the same as that of the aperture grill in the first embodiment.

Figure 4A:
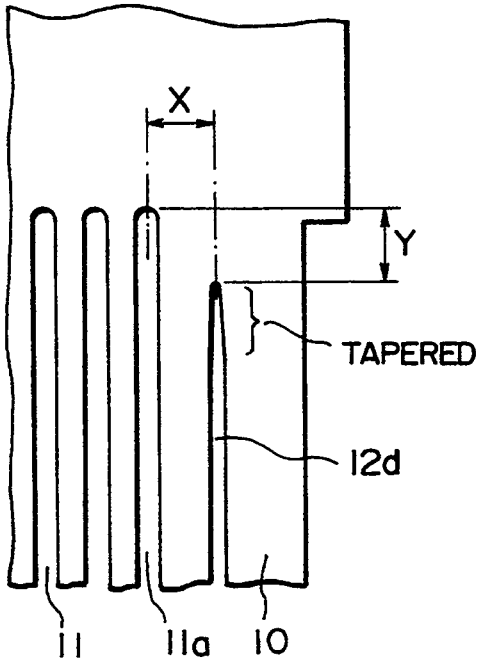
FIGS. 4(*a*) and 4(*b*) are a fragmentary plan view and a fragmentary enlarged sectional view, respectively, of a flat grill plate employed in an aperture grill in a fourth embodiment according to the present invention.
Figure 4B:
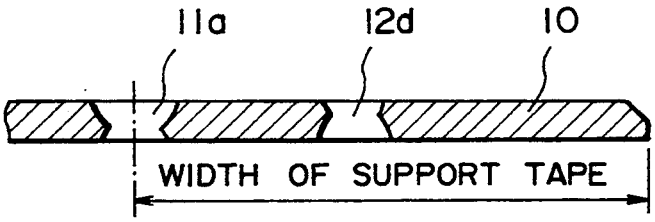
Figure 5:
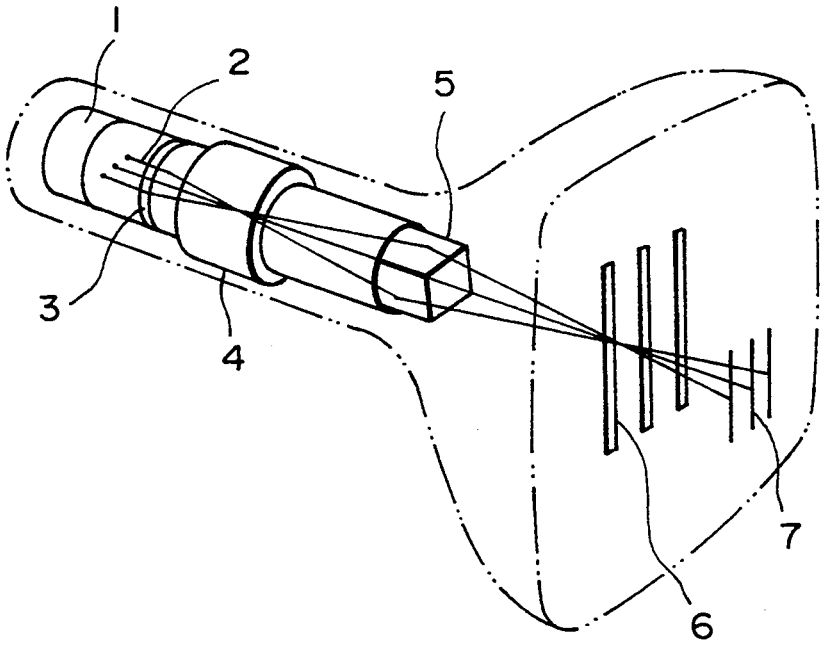
FIG. 5 (PRIOR ART)
FIG. 5 is a schematic perspective view of a Trinitron picture tube.

FIGS. 4(*a*) and 4(*b*) are a fragmentary plan view and a fragmentary enlarged sectional view, respectively, of a flat grill plate 10 employed in an aperture grill in a fourth embodiment according to the present invention.

In forming extra slits 12*d* in the flat grill plate 10 by etching, the back surface of the flat grill plate 10 is etched by a relatively large amount, namely, by a relatively large back etching amount, to increase the height of the tape edge so that the practical intercepting effect is enhanced. The extra slit 12*d* is a slit having a tapered end similar to that of the extra slit 12*a* of the flat grill plate of the first embodiment. The width and position of the extra slits 12*d* are the same as those of the extra slits 12*a* of the flat grill plate 10 of the first embodiment. The effect of the aperture grill of the fourth embodiment is the same as that of the aperture grills of the foregoing embodiments.

Extra slits according to the present invention are not limited to those of the foregoing embodiments; modifications of the extra slits of the foregoing embodiments are possible without departing from the scope of the present invention set forth in the claims.

As is apparent from the foregoing description, the extra slits formed, respectively, outside the end slits among the slits formed in the effective area of the picture prevent the change of the width of the end slits. The present invention makes the correction of the aperture grill in the visual inspection process unnecessary, and improves the yield and productivity of the aperture grill manufacturing system.

Although the invention has been described in its preferred forms with a certain degree of particularity, obviously many changes and modifications are possible therein. It is therefore to be understood that the present invention may be practiced otherwise than as specifically described herein without departing from the scope and spirit thereof.

What is claimed is:

1. A flat grill plate for attachment to a frame for mounting in a picture tube having a panel with phosphor stripes thereon, comprising:

a thin metal sheet provided with a plurality of parallel slits with each slit running in a vertical direction from a top to a bottom of an effective picture area to be covered by the grill plate of the picture tube, said plurality of slits being arranged across said effective picture area and including respective end slits at left and right sides of and within the effective picture area; and outside of the effective picture area, respective left and right extra slits being provided parallel to and alongside the left and right end slits but outside the effective picture area at the left and right sides of the effective picture area for preventing deformation of the slits within the picture area when the grill plate is mounted to the frame, said left and right extra slits extending from a region near the top to a region near the bottom of the effective picture area and having a relatively narrow width selected sufficiently smaller than a width of said plurality of slits within the effective picture area such that during a manufacturing process when the aperture grill is used for masking in the creation of the phosphor stripes on the picture tube panel, exposure light rays passing through the slits to expose and form the phosphor stripes will not pass through and will be intercepted by the extra slits, thus eliminating the need to cover over the extra slits when the aperture grill is being used as a mask.

2. An aperture grill plate according to claim 1 wherein each of the extra slits is shorter in length than the slits within the effective picture area.

3. An aperture grill plate according to claim 1 wherein each of the extra slits has a tapered end.

4. An aperture grill plate according to claim 1 wherein each of the extra slits has an opening portion at one side of the plate which is laterally shifted relative to an opposite adjoining opening at an opposite side of the plate.

5. An aperture grill plate according to claim 1 wherein each of the extra slits has an opening portion adjacent one side of the plate which is larger than an adjoining opening at an opposite side of the plate.

6. A method for employing a flat grill plate which is to be attached to a frame for mounting in a picture tube for masking in the creation of phosphor stripes on a panel of the picture tube, comprising the steps of:

forming the grill plate as a thin metal sheet with a plurality of parallel slits extending vertically from a top to a bottom of an effective picture area of the picture tube, the strips being arranged from a left to a right side of the effective picture area and including end slits positioned at the left and right sides within the effective picture area, and providing left and right extra slits at the left and right sides outside of the effective picture area and parallel to and alongside the end slits within the picture area, said extra slits running from a region near the top to a region near the bottom of the effective picture area;

providing said left and right extra slits with a relatively narrow width smaller than a width of the slits within the effective picture area;

employing the flat grill plate as a mask for forming the phosphor stripes on the picture tube panel and selecting said relatively narrow width of the extra slits for the masking so that an exposure light used during the masking process and passing through the slits in the effective picture area will not pass through the extra slits and will be intercepted thereby so that the phosphor stripes will be formed on the panel only within the effective picture area and the extra slits do not have to be covered over; and employing said flat grill plate in said picture tube by attaching it to the frame, said extra slits substantially preventing deformation of the slits within the picture area when the flat grill plate is mounted to the frame.

* * * * *